United States Patent [19]

Langguth

[11] 4,015,873

[45] Apr. 5, 1977

[54] RETRIEVER

[75] Inventor: Arthur F. Langguth, San Diego, Calif.

[73] Assignee: The United States of America as represented by the Secretary of the Navy, Washington, D.C.

[22] Filed: Dec. 22, 1975

[21] Appl. No.: 642,801

[52] U.S. Cl. ..... 294/66 R; 294/113

[51] Int. Cl.[2] ..... B66C 1/28

[58] Field of Search ..... 294/66 R, 81 R, 86 R, 294/110 R, 113, 114; 114/51

[56] References Cited

UNITED STATES PATENTS

| | | | |
|---|---|---|---|
| 1,039,727 | 10/1912 | Gilmartin | 294/110 R |
| 3,112,038 | 11/1963 | Breivik | 294/113 X |
| 3,178,215 | 4/1965 | Reeves | 294/66 R |
| 3,722,941 | 3/1973 | Seiple et al. | 294/66 R |

*Primary Examiner*—Johnny D. Cherry
*Attorney, Agent, or Firm*—Richard S. Sciascia; Ervin F. Johnston; Thomas Glenn Keough

[57] ABSTRACT

A retriever is configured to engage a sunken object by a marine mammal. After the object has been engaged by a U-shaped retriever having a pair of spring biased fingers, a retrieval line allows the raising of the sunken object to the surface. Only a relatively light pushing force need be exerted by the mammal to override the resistance of the spring biased fingers as they slide about and finally retain the object. High reliability is ensured by the uncomplicated design of the retriever and heavy loads in the neighborhood of several thousand pounds may be raised by a retriever weighing less than five pounds.

6 Claims, 4 Drawing Figures

RETRIEVER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Devices for recovering underwater objects, such as practice mines and torpedoes, have undergone a sophisticated evolution. Generally, divers no longer need to grope about in cold, murky, deep water to affix hoisting lines to the expended devices. Marine mammals have shown an unusual ability for performing such tasks due to their improved eyesight, better respiratory cycles, and a variety of other reasons. Trainers have found that after a short period of time the animals could be trained to locate a sunken device by homing-in on a source of sound carried on the expended ordnance. When they got close enough to see it, they would attach recovery device and retreival line. The grabber disclosed in U.S. Pat. No. 3,722,941 issued to Ronald L. Seiple and entitled "Marine Mammal Underwater Attachment and Recovery Tool" served quite well during the recovery of a lightweight breed of practice torpedoes. However, care needed to be exercised in handling or the mechanism might become mechanically disabled. Reliable engagement was not assured unless it was aligned nearly perfectly. Marine sediment created problems and the recovery of ordnance partially buried in the ocean floor was difficult. Some of these problems have been avoided by the "Improved Grabber", disclosed in a pending U.S. patent application, Ser. No. 607,162, now U.S. Pat. No. 3,986,745 to the present inventor, Arthur F. Langguth. This grabber uses spring biased telescoping sections of tubing to reach around a sunken object. In the case of objects partially buried in the sand, a compressed gas arrangement is added to jet away the sediment to allow passage of the tubing sections and engagement. In spite of the proven capabilities of the state of the art, however, a less complicated and, hence, more reliable retrieving device should be designed. Thus, there is a continuing need in the state of the art for a highly reliable grabber capable of lifting loads weighing several thousand pounds.

SUMMARY OF THE INVENTION

The present invention is directed to providing an apparatus for permitting the recovery of a sunken object. Means are provided for fitting into the mouth of a marine mammal which is coupled to an essentially U-shaped framework. The opening across the mouth of the framework is sized to be slightly larger than the object and a pair of inwardly extending spring biased fingers are disposed at the extreme ends. Each of the fingers is adapted for one-way rotation out of the way while the object enters the framework. Once in, the fingers snap back in place to retain the object and prevent its withdrawal.

An object of the invention is to provide an improved retriever of sunken objects.

Another object is to provide a retriever being of uncomplicated construction so as to enhance reliability.

Still another object is to provide a retriever which is adaptable for deployment by a marine mammal.

Another object is to provide a lightweight retriever capable of supporting substantial weights.

Yet another object is to provide a retriever sized to engage only those objects having predetermined dimensions.

These and other objects of the invention will become more readily apparent from the ensuing description when taken with the drawings.

BRIEF DESCRIPTION OF THE DRAWINGS

FIG. 2 shows the invention held by a sea lion with an expended view of one of the engaging assemblies in.

DESCRIPTION OF THE PREFERRED EMBODIMENT

Figure 1:
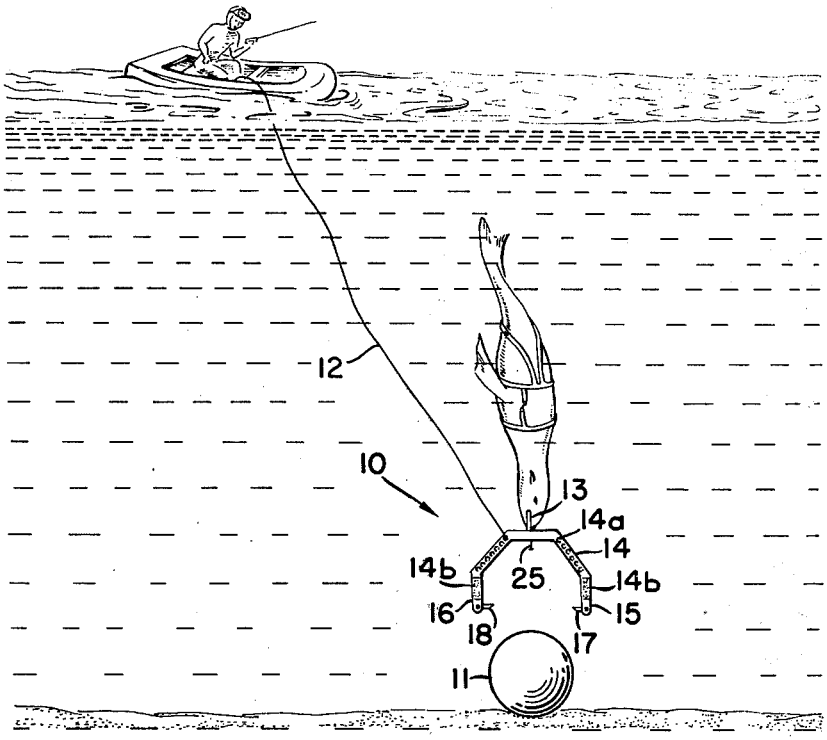
FIG. 1 is an isometric depiction of the invention being deployed by a sea lion.

Referring now to the drawings, a retriever 10 is about to engage a sunken object 11 to allow its retrieval to the surface by a hoisting line 12. The sunken objects, which this invention is designed to recover, are practice mines. Sea lions are trained to bring a retriever to the mine which is provided with a pinger or an acoustic noise source not shown in the drawings.

After the animal is attracted acoustically to the near vicinity of the mine, the animal visually connects the retreiver. A mouthpiece 13 is shaped so as not to block the animal's vision and is fabricated from a pair of rubber sheets **13*a* and a sandwiched metal plate 13*b*. The metal plate provides strength and serves to connect the mouthpiece to U-shaped 14.**

Practice mines can each weigh in excess of several thousand pounds. Therefore, the retriever is substantially designed to allow their recovery via the retrieval line.

The U-shaped frame is shaped with "I beam" cross-sectional configuration and is made of titanium. Its dimensions are only one inch by one and five eighths inch, yet it has almost a five thousand pounds lift capacity. Holes **14*a* are provided along its length to reduce weight. Blocks 14*b*** of bonded glass hollow microspheres are mounted on the legs of the U-shaped framework to help offset any front-heavy characteristics it might otherwise have and also to reduce weight. Blocks fashioned from the commercially available material marketed under the trademark "Syntactic Foam" function very well.

The legs of the U-shaped frame terminate in rounded ends 15 and 16. The rounded ends help guide the retriever around the recovery object.

A pair of opposed fingers 17 and 18 extend from the rounded ends. The fingers are formed from hardened titanium and have sharpened points **17*a* and 18*a* to better secure the object. The fingers extend through friction-free bearings 19 and 20 which are journaled in bores 15*a* and 16*a*. The bearings are fashioned from the material commercially marketed under the tradename "Teflon". Pins 21 and 22** coaxially extend through the two bearings and hold the fingers at a predetermined extension.

Figure 2:
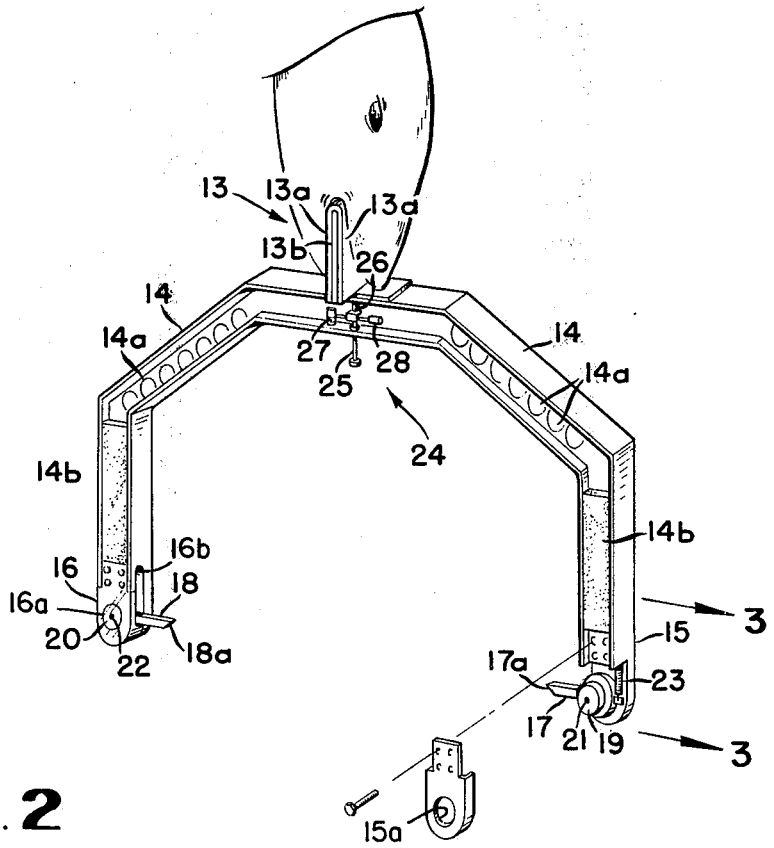
Figure 3:
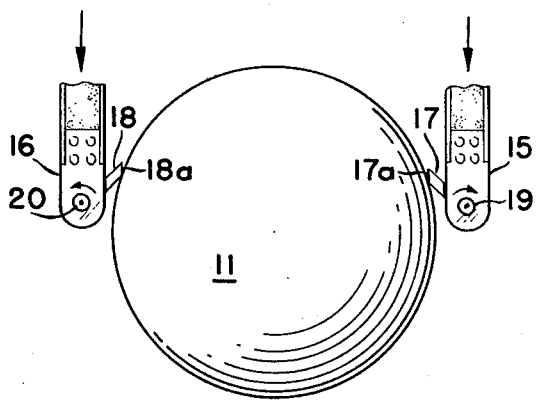
FIG. 3 schematically depicts a partial override of a sunken object by the spring biased fingers.

On the ends opposite from the points of the fingers biasing springs 23 are connected and are anchored to the U-shaped frame, only one spring is shown in FIG. 2. The springs hold the fingers to normally extend perpendicularly from the ends of the U-shaped frame. When the fingers and bearings are rotated to allow bypass of the sunken object during retrieval, the springs urge the fingers back to the normal extended position. The spring's constant is not excessive so that a moderate pushing force by the marine mammal can overcome the biasing springs to permit engagement of the sunken object. The fingers rotate out of the path of the object and into slots, only one of which, 16*b*, is shown in the drawings. This allows the free bypassing of the object between the legs of the frame.

After the broadest dimension of the object has bypassed the fingers, their biasing springs rotate the bearings in opposite directions to reposition the fingers in their normal extended positions. Now the object is captured in the retriever because the fingers arrest outward travel from between the legs of the U-shaped frame. Sharpened points 17*a* and 18*a* dig into the object and prevent it from dropping out or sliding lengthwise. All that remains is to haul it up by the retrieval line.

Attachment of the retriever is accomplished by marine mammals. Experience has shown that sea lions, for example, cannot definitely tell when the spring biased fingers snapped back to their normal position to retain the object. Some sort of an indication was needed to let the animal know that engagement has been made so that it can release the mouthpiece and return to the surface.

Figure 4:
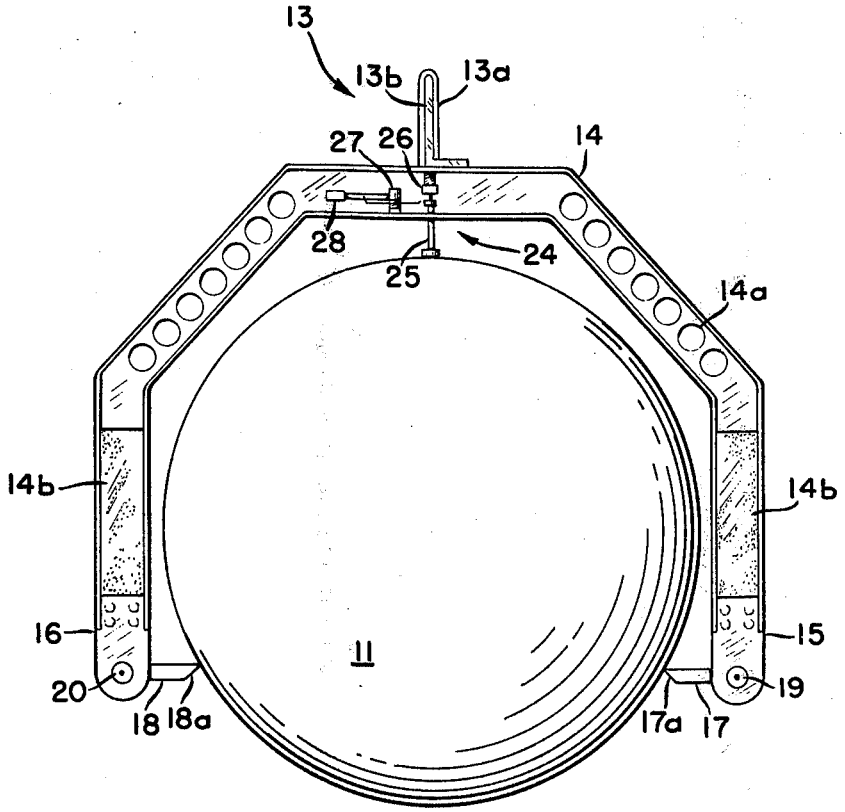
FIG. 4 is a schematic representation of an engagement and retention of the object prior to its recovery.

A snap assembly 24 was mounted in the cradle of the U-shaped frame and had its plunger 25 extending toward the recovery object. The plunger retained a catch 26 which held a spring loaded arm 27. Noting FIG. 4, as the plunger contacted the upper surface of the recovery object and was pushed in, catch 26 released the spring loaded arm and a rapper 28 struck the U-shaped frame. The animal was trained to know that the object had been secured when the snapping sound was made and it would release its grip on the mouthpiece and return to the surface.

The present invention is accepted by animals for several reasons. One is that it weighs no more than four to five pounds. However, this does not imply that it cannot lift a substantial load. The specific design referred to above has supported loads weighing nearly five thousand pounds. Another reason the animals work well with this retriever is that the biasing force of the biasing springs 23 was selected to require only about two pounds pushing force by the animal to engage the retriever. This is particularly important because an excessive force can make an animal's mouth sore and it will refuse to accept the retriever.

Obviously, many modifications and variations of the present invention are possible in the light of the above teachings, and, it is therefore understood that the invention may be practiced otherwise than as specifically described.

What is claimed is:

1. An apparatus for permitting the retrieval of a sunken object having a known dimension comprising:

means configured for gripping by a marine mammal;

means connected to the gripping means for fitting about the sunken object when positioned thereat by the marine mammal;

means carried on the fitting means for rotating to a position at least partially within the dimensions of the fitting means as the object is being positioned in the fitting means and for rotating to a position extending from the fitting means after the object has been positioned in the fitting means to lock the object therein;

means carried on the fitting means for reducing the weight of the apparatus; and means carried on the fitting means for aurally indicating the positioning of the object in the fitting means to the marine mammal.

2. An apparatus according to claim 1 in which the gripping means is a mouthpiece configured to be carried in the mouth of the marine mammal and formed of a rigid plate sandwiched between a pair of compliant layers.

3. An apparatus according to claim 2 in which the fitting means is a U-shaped member, the legs of which are spaced apart a sufficient distance to accommodate the known dimension of the object, said U-shaped member has an I beam, cross-sectional configuration for strength and a number of holes provided in it for reduced weight.

4. An apparatus according to claim 3 in which the reducing means is hollow microspheres carried in a bonding agent and mounted on each leg of the U-shaped member and the indicating means is a snap mechanism mounted on the U-shaped member at a position near the mouthpiece.

5. An apparatus according to claim 4 in which the rotating means is a rotatable bearing disposed near the ends of each of the legs of the U-shaped member, each bearings having a finger extending therefrom in a mutually opposed relationship, each finger has a biasing spring attached thereto coupled to bias the finger in an orthogonal orientation from a leg.

6. An apparatus to claim 5 in which each leg is provided with a slot shaped to receive a finger therein as the object overcomes the biasing spring when the object enters the U-shaped member.

* * * * *